US008497892B2

(12) United States Patent
Nakaie

(10) Patent No.: US 8,497,892 B2
(45) Date of Patent: Jul. 30, 2013

(54) EXPOSURE APPARATUS AND IMAGE FORMING APPARATUS

(75) Inventor: Katsuhiko Nakaie, Ebina (JP)

(73) Assignee: Fuji Xerox Co., Ltd., Kanagawa (JP)

( * ) Notice: Subject to any disclaimer, the term of this patent is extended or adjusted under 35 U.S.C. 154(b) by 353 days.

(21) Appl. No.: 12/778,621

(22) Filed: May 12, 2010

(65) Prior Publication Data

US 2011/0115869 A1 May 19, 2011

(30) Foreign Application Priority Data

Nov. 17, 2009 (JP) ..... 2009-262119

(51) Int. Cl.
*B41J 2/435* (2006.01)
*B41J 27/00* (2006.01)

(52) U.S. Cl.
USPC ..... 347/224; 347/256

(58) Field of Classification Search
USPC ..... 347/224, 256
See application file for complete search history.

(56) References Cited

U.S. PATENT DOCUMENTS 4,731,621 A * 3/1988 Hayamizu et al. ..... 347/66
7,593,149 B2 * 9/2009 Tomita ..... 359/197.1

FOREIGN PATENT DOCUMENTS

JP 2004-006592 A 1/2004
JP 2004006592 * 1/2004

* cited by examiner

*Primary Examiner* — Uyen Chau N Le
*Assistant Examiner* — Kajli Prince
(74) *Attorney, Agent, or Firm* — Sughrue Mion, PLLC

(57) ABSTRACT

An exposure apparatus includes a light source that emits a plurality of light beams, a substrate on which the light source is mounted, a positioning member provided on a housing and being in contact with a positioning surface provided around the light source to position the light source with respect to the housing in an optical axis direction, the housing accommodating an optical system that guides the light beams, and an attachment member attached to the housing and including a portion that extends in a direction substantially perpendicular to the optical axis direction and that is bent over, an end of the bent portion being attached to the substrate such that the positioning surface around the light source is urged against the positioning member and the substrate is attached to the housing.

10 Claims, 13 Drawing Sheets

EXPOSURE APPARATUS AND IMAGE FORMING APPARATUS

CROSS-REFERENCE TO RELATED APPLICATIONS

This application is based on and claims priority under 35 USC 119 from Japanese Patent Application No. 2009-262119 filed Nov. 17, 2009.

BACKGROUND

The present invention relates to an exposure apparatus and an image forming apparatus.

SUMMARY

According to an aspect of the present invention, an exposure apparatus includes a light source that emits a plurality of light beams; a substrate on which the light source is mounted; a positioning member provided on a housing and being in contact with a positioning surface provided around the light source to position the light source with respect to the housing in an optical axis direction, the housing accommodating an optical system that guides the light beams; and an attachment member attached to the housing and including a portion that extends in a direction substantially perpendicular to the optical axis direction and that is bent over, an end of the bent portion being attached to the substrate such that the positioning surface around the light source is urged against the positioning member and the substrate is attached to the housing.

BRIEF DESCRIPTION OF THE DRAWINGS

Exemplary embodiments of the present invention will be described in detail based on the following figures, wherein.

DETAILED DESCRIPTION

An exposure apparatus and an image forming apparatus according to an exemplary embodiment of the present invention will be described with reference to FIGS. 1 to 13.

Overall Structure

Figure 13:
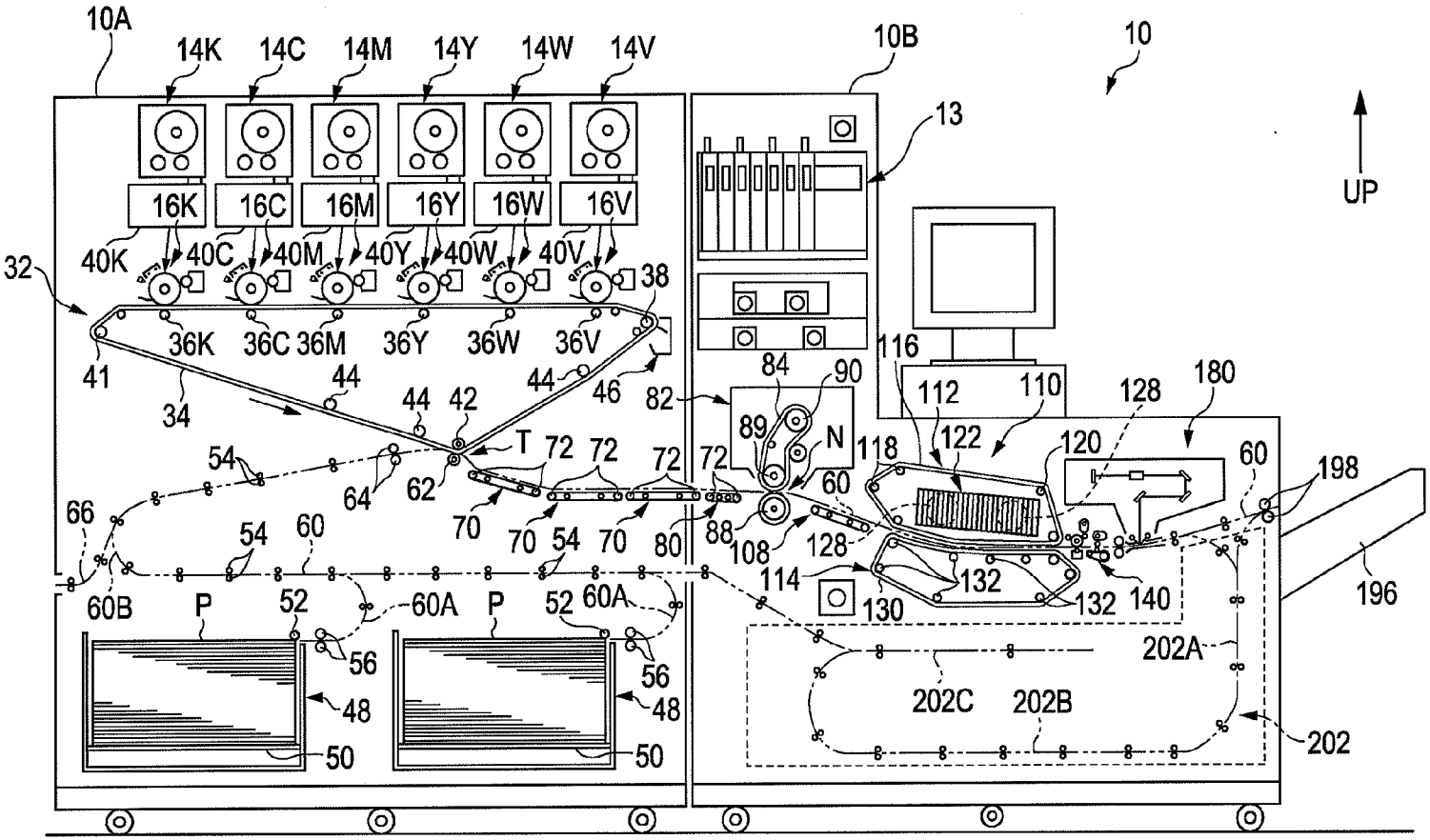
FIG. 13 is a schematic diagram illustrating the image forming apparatus according to the exemplary embodiment of the present invention.

An image forming apparatus 10 according to the present exemplary embodiment forms full-color or monochrome images. As illustrated in FIG. 13, the image forming apparatus 10 includes a first housing 10A and a second housing 10B. The first housing 10A accommodates a first processing section at one side (left side in FIG. 13) of the image forming apparatus 10 in a horizontal direction. The second housing 10B is separably connected to the first housing 10A and accommodates a second processing section at the other side (right side in FIG. 13) of the image forming apparatus 10 in the horizontal direction.

An image-signal processing unit 13 is provided in an upper section of the second housing 10B. The image-signal processing unit 13 subjects image data transmitted from an external apparatus, such as a computer, to image processing.

Toner cartridges 14V, 14W, 14Y, 14M, 14C, and 14K are arranged along the horizontal direction in an upper section of the first housing 10A. The toner cartridges 14V, 14W, 14Y, 14M, 14C, and 14K are replaceable and contain toners of respective colors: a first specific color (V), a second specific color (W), yellow (Y), magenta (M), cyan (C), and black (K).

The first and second specific colors are suitably selected from colors (including transparent colors) other than yellow, magenta, cyan, and black. In the following descriptions, the letters 'V', 'W', 'Y', 'M', 'C', and 'K' are attached to reference numerals denoting components corresponding to the first specific color (V), the second specific color (W), yellow (Y), magenta (M), cyan (C), and black (K), when they are to be distinguished from each other. The letters are omitted when it is not necessary to distinguish the components corresponding to the first specific color (V), the second specific color (W), yellow (Y), magenta (M), cyan (C), and black (K) from each other.

Six image forming units 16 corresponding the respective colors of toner are arranged along the horizontal direction in a section below the toner cartridges 14 such that the image forming units 16 correspond to the respective toner cartridges 14.

Each image forming unit 16 includes an exposure apparatus 40 that receives image data subjected to the image processing performed by the image-signal processing unit 13 from the image-signal processing unit 13. Each exposure apparatus 40 modulates light beams L in accordance with the received image data and irradiates an image bearing member 18, which will be described below, with the modulated light beams L (see FIG. 12).

Figure 12:
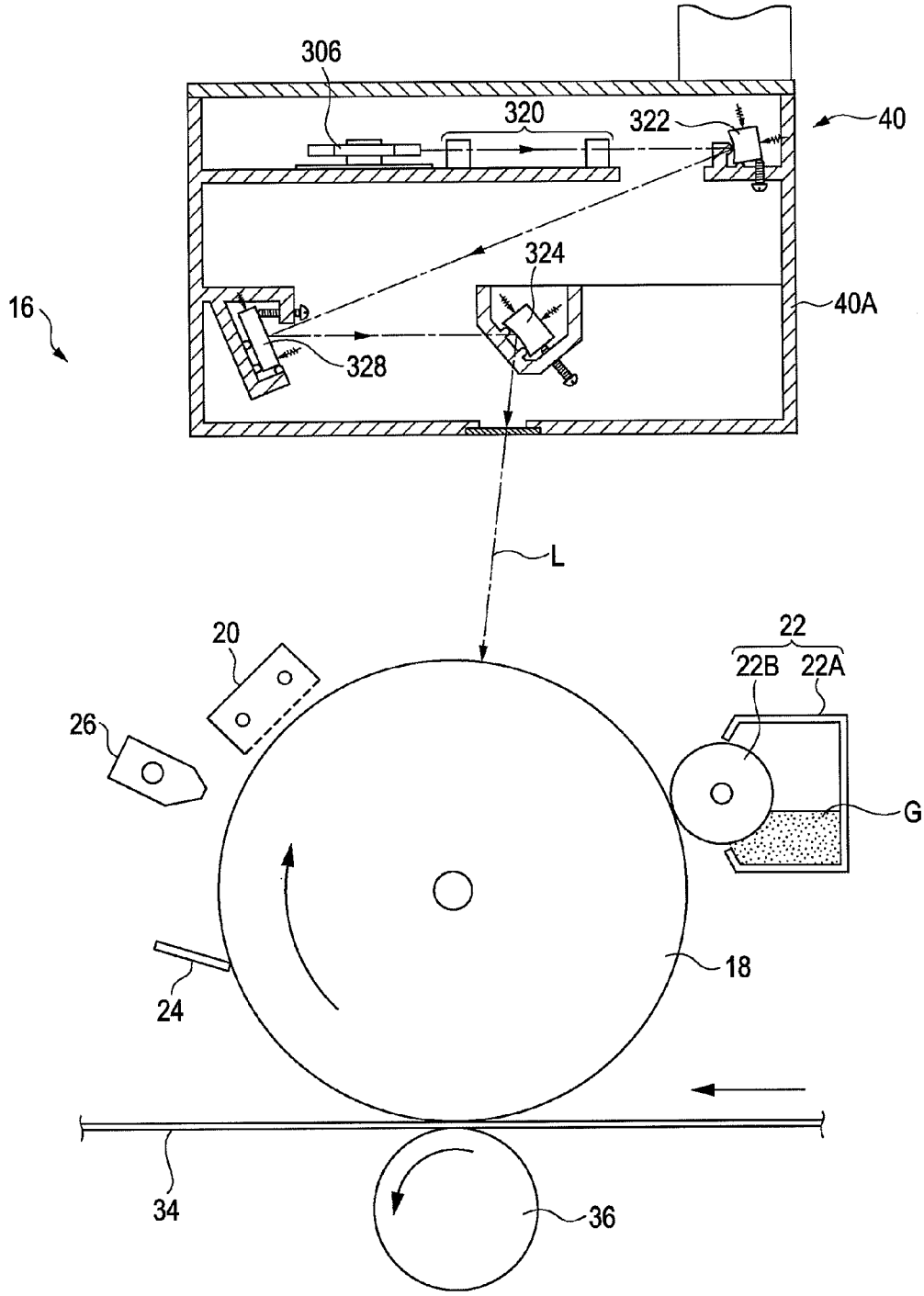
FIG. 12 is a schematic diagram illustrating an image forming unit included in an image forming apparatus according to the exemplary embodiment of the present invention.

As illustrated in FIG. 12, the image bearing member 18 is included in each image forming unit 16 and is rotated in one direction (clockwise in FIG. 12). The image bearing member 18 is irradiated with the light beams L by the corresponding exposure apparatus 40 so that an electrostatic latent image is formed on the image bearing member 18. The exposure apparatus 40 will be described in detail below.

A scorotron charging device 20, a developing device 22, a blade 24, and a charge-eliminating device 26 are provided around each image bearing member 18. The scorotron charging device 20 charges the image bearing member 18 by a corona discharge method (non-contact charging method). The developing device 22 develops the electrostatic latent image formed on the image bearing member 18 by the exposure apparatus 40 with a developing agent. The blade 24 serves as a removing member that removes the developing agent remaining on the image bearing member 18 after a transfer process. The charge-eliminating device 26 eliminates the electric charge on the image bearing member 18 by irradiating the image bearing member 18 with light after the transfer process.

The scorotron charging device 20, the developing device 22, the blade 24, and the charge-eliminating device 26 face the surface of the image bearing member 18, and are arranged in that order in a direction from an upstream position to a downstream position along the rotation direction of the image bearing member 18.

The developing device 22 includes a developing-agent container 22A that contains a developing agent G including toner and a developing roller 22B that supplies the developing agent G contained in the developing-agent container 22A to the image bearing member 18. The developing-agent container 22A is connected to the corresponding toner cartridge 14 (see FIG. 13) by a toner supply path (not shown), and receives the toner from the toner cartridge 14.

As illustrated in FIG. 13, a transfer unit 32 is provided below the image forming units 16. The transfer unit 32 includes a loop-shaped intermediate transfer belt 34 that is in contact with the image bearing members 18 and primary transfer rollers 36 that serve as primary transfer members for transferring toner images formed on the respective image bearing members 18 onto the intermediate transfer belt 34.

The intermediate transfer belt 34 is wrapped around a driving roller 38 driven by a motor (not shown), a tension-applying roller 41 that applies a tension to the intermediate transfer belt 34, a counter roller 42 that is opposed to a secondary transfer roller 62, which will be described below, and wrap rollers 44. The intermediate transfer belt 34 is rotated in one direction (counterclockwise in FIG. 13) by the driving roller 38.

Each primary transfer roller 36 is opposed to the image bearing member 18 in the corresponding image forming unit 16 with the intermediate transfer belt 34 interposed therebetween. A transfer bias voltage with a polarity opposite to the polarity of the toner is applied to each primary transfer roller 36 by an electricity supplying unit (not shown). Accordingly, the toner image formed on each image bearing member 18 is transferred onto the intermediate transfer belt 34.

A removing device 46 for removing toner, paper dust, etc., that remain on the intermediate transfer belt 34 by bringing a blade into contact with the intermediate transfer belt 34 is disposed opposite the driving roller 38 across the intermediate transfer belt 34.

Two recording-medium containers 48 that contain recording media, such as sheets of paper, are arranged along the horizontal direction in a section below the transfer unit 32.

The recording-medium containers 48 can be pulled out from the first housing 10A. Each recording-medium container 48 is provided with a feed roller 52 at one end (right end in FIG. 13) of the recording-medium container 48 in an upper section thereof. The feed rollers 52 feed the recording media P from the recording-medium containers 48 into a conveying path 60.

The recording media P are stacked on a bottom plate 50 in each recording-medium container 48. The bottom plate 50 in each recording-medium container 48 is moved downward in response to a command from a controller (not shown) when the recording-medium container 48 is pulled out from the first housing 10A. When the bottom plate 50 is moved downward, a space to be filled with the recording media P by a user is provided in the recording-medium container 48.

When the recording-medium container 48 that has been pulled out from the first housing 10A is pushed into the first housing 10A again, the bottom plate 50 is moved upward in response to a command from the controller. When the bottom plate 50 is moved upward, the topmost one of the recording media P stacked on the bottom plate 50 comes into contact with the feed roller 52.

Separation rollers 56 are provided downstream of each feed roller 52 in a recording-medium conveying direction (hereinafter sometimes described simply as "downstream"). The recording media P are fed from the recording-medium containers 48 while being stacked on each other, and the separation rollers 56 separate the recording media P from each other. Conveying rollers 54 that convey the recording media P downstream in the conveying direction are provided downstream of the separation rollers 56.

The conveying path 60 is provided between the transfer unit 32 and the recording-medium containers 48. The conveying path 60 extends to a transfer position T between the secondary transfer roller 62 and the counter roller 42, and includes first curved portions 60A at which the recording media P fed from the recording-medium containers 48 are turned over to the left in FIG. 13 and a second curved portion 60B at which the recording media P are turned over to the right in FIG. 13.

A transfer bias voltage with a polarity opposite to the polarity of the toner is applied to the secondary transfer roller 62 by the electricity supplying unit (not shown). With this structure, the toner images of the respective colors that have been transferred onto the intermediate transfer belt 34 in a superimposed manner are transferred by the secondary transfer roller 62 onto the recording medium P that has been conveyed along the conveying path 60.

An auxiliary path 66 extends from a side surface of the first housing 10A and joins the second curved portion 60B of the conveying path 60. Accordingly, recording media P stored in another recording-medium container (not shown) that is disposed next to the first housing 10A can be fed into the conveying path 60 through the auxiliary path 66.

Conveying belts 70 are provided downstream of the transfer position T in the first housing 10A. The conveying belts 70 convey the recording medium P onto which the toner images have been transferred to the second housing 10B. A conveying belt 80 is provided in the second housing 10B to convey the recording medium P that has been conveyed thereto by the conveying belts 70 further downstream.

Each of the conveying belts 70 and 80 is loop-shaped, and is wrapped around a pair of wrap rollers 72. The pair of wrap rollers 72 are disposed at upstream and downstream positions in the conveying direction of the recording medium P, and one of the wrap rollers 72 rotates to move the corresponding conveying belt 70 (or the conveying belt 80) in one direction (clockwise in FIG. 13).

A fixing unit 82 that fixes the toner images that have been transferred onto the surface of the recording medium P by application of heat and pressure is provided downstream of the conveying belt 80.

The fixing unit 82 includes a fixing belt 84 and a pressing roller 88 disposed such that the pressing roller 88 is in contract with the fixing belt 84 at the bottom of the fixing belt 84. A fixing section N in which the toner images are fixed by pressing and heating the recording medium P is provided between the fixing belt 84 and the pressing roller 88.

The fixing belt 84 is loop-shaped and is wrapped around a driving roller 89 and a driven roller 90. The driving roller 89 is opposed to the pressing roller 88 at the top of the pressing roller 88, and the driven roller 90 is disposed above the driving roller 89.

Each of the driving roller 89 and the driven roller 90 contains a heating unit, such as a halogen heater, for heating the fixing belt 84.

As illustrated in FIG. 13, a conveying belt 108 that conveys the recording medium P ejected from the fixing unit 82 downstream is provided downstream of the fixing unit 82. The conveying belt 108 has a structure similar to the structure of the conveying belts 70.

A cooling unit 110 that cools the recording medium P heated by the fixing unit 82 is provided downstream of the conveying belt 108.

The cooling unit 110 includes an absorbing device 112 that absorbs heat from the recording medium P and a pressing device 114 that presses the recording medium P against the absorbing device 112. The absorbing device 112 is disposed on one side (upper side in FIG. 13) of the conveying path 60, and the pressing device 114 is disposed on the other side (lower side in FIG. 13) of the conveying path 60.

The absorbing device 112 includes a loop-shaped absorbing belt 116 that comes into contact with the recording medium P to absorb heat from the recording medium P. The absorbing belt 116 is wrapped around a driving roller 120 that transmits a driving force to the absorbing belt 116 and wrap rollers 118.

A heat sink 122 made of an aluminum material is disposed inside the absorbing belt 116. The heat sink 122 comes into surface contact with the absorbing belt 116 and dissipates the heat absorbed by the absorbing belt 116.

In addition, fans 128 for removing the heat from the heat sink 122 and discharging the heat to the outside are arranged on a back side (side not visible in FIG. 13) of the second housing 10B.

The pressing device 114 that presses the recording medium P against the absorbing device 112 includes a loop-shaped pressing belt 130 that conveys the recording medium P while pressing the recording medium P against the absorbing belt 116. The pressing belt 130 is wrapped around wrap rollers 132.

A correcting device 140 that flattens the recording medium P, which may be curved (or curled), by conveying the recording medium P while nipping the recording medium P is provided downstream of the cooling unit 110.

A detection device 180 that detects a toner density defect, an image defect, an image position defect, etc., of the toner images fixed on the recording medium P is provided downstream of the correcting device 140.

The detection device 180 detects the toner density defect, the image defect, the image position defect, etc., by emitting light from a light source toward the recording medium P and receiving light reflected upward by the recording medium P with a detection element, such as a charge coupled device (CCD) image sensor.

Ejection rollers 198 are provided downstream of the detection device 180. The ejection rollers 198 eject the recording medium P having an image formed on one side thereof to an ejection unit 196 attached to a side surface of the second housing 10B.

In the case where images are to be formed on both sides of the recording medium P, the recording medium P ejected from the detection device 180 is conveyed to a reversing path 202 provided downstream of the detection device 180.

The reversing path 202 includes a branching path 202A that branches from the conveying path 60, a sheet-conveying path 202B along which the recording media P conveyed from the branching path 202A is conveyed toward the first housing 10A, and a reversing path 202C along which the recording media P conveyed from the sheet-conveying path 202B is turned over and conveyed in a switchback manner to reverse the recording media P.

With this structure, the recording medium P conveyed along the reversing path 202C in a switchback manner is conveyed toward the first housing 10A and enters the conveying path 60 disposed above the recording-medium containers 48. Thus, the recording medium P is conveyed to the transfer position T again.

An image forming process performed by the image forming apparatus 10 will now be described.

The image data subjected to the image processing performed by the image-signal processing unit 13 is transmitted to each of the exposure apparatuses 40. Each exposure apparatus 40 emits the light beams L corresponding to the image data to expose the corresponding image bearing member 18, which has been charged by the scorotron charging device 20, to the light beams L. As a result, an electrostatic latent image is formed on each image bearing member 18.

As illustrated in FIG. 12, the electrostatic latent image formed on each image bearing member 18 is developed by the developing device 22. Thus, the toner images of the respective colors, that is, the first specific color (V), the second specific color (W), yellow (Y), magenta (M), cyan (C), and black (K), are formed.

As illustrated in FIG. 13, the toner images of the respective colors formed on the image bearing members 18 included in the image forming units 16V, 16W, 16Y, 16M, 16C, and 16K are transferred onto the intermediate transfer belt 34 in a superimposed manner by the six primary transfer rollers 36V, 36W, 36Y, 36M, 36C, and 36K.

The toner images of the respective colors that have been transferred onto the intermediate transfer belt 34 in a superimposed manner are transferred by the secondary transfer roller 62 onto the recording medium P that has been conveyed from one of the recording-medium containers 48. The recording medium P onto which the toner images have been transferred is conveyed by the conveying belts 70 toward the fixing unit 82 included in the second housing 10B.

The toner images of the respective colors on the recording medium P are fixed on the recording medium P by being heated and pressed by the fixing unit 82. The recording medium P on which the toner images have been fixed is cooled when the recording medium P passes through the cooling unit 110, and is conveyed to the correcting device 140, where the recording medium P in the curved state is flattened.

After the recording medium P in the curved state is flattened, the detection device 180 inspects the recording medium P for image defects and other defects. Then, the recording medium P is ejected to the ejection unit 196 by the ejection rollers 198.

In the case where an image is to be formed on a surface on which no image has been formed (in the case of duplex printing), the recording medium P is reversed by the reversing path 202 after passing through the detection device 180, and is conveyed to the conveying path 60 disposed above the recording-medium containers 48. Then, toner images are formed on the back side of the recording medium P by the above-described process.

In the image forming apparatus 10 according to the present exemplary embodiment, components for forming images in the first and second specific colors (the image forming units 16V and 16W, the exposure apparatuses 40V and 40W, the toner cartridges 14V and 14W, and the primary transfer rollers 36V and 36W) can be attached to the first housing 10A as additional components in accordance with the selection of the user. Therefore, the image forming apparatus 10 may also be structured such that the components for forming the images in the first and second specific colors are omitted or such that only the components for forming an image in one of the first and second specific colors are provided.

Structure of Exposure Apparatus

The structure of each exposure apparatus 40 will now be described.

Figure 10:
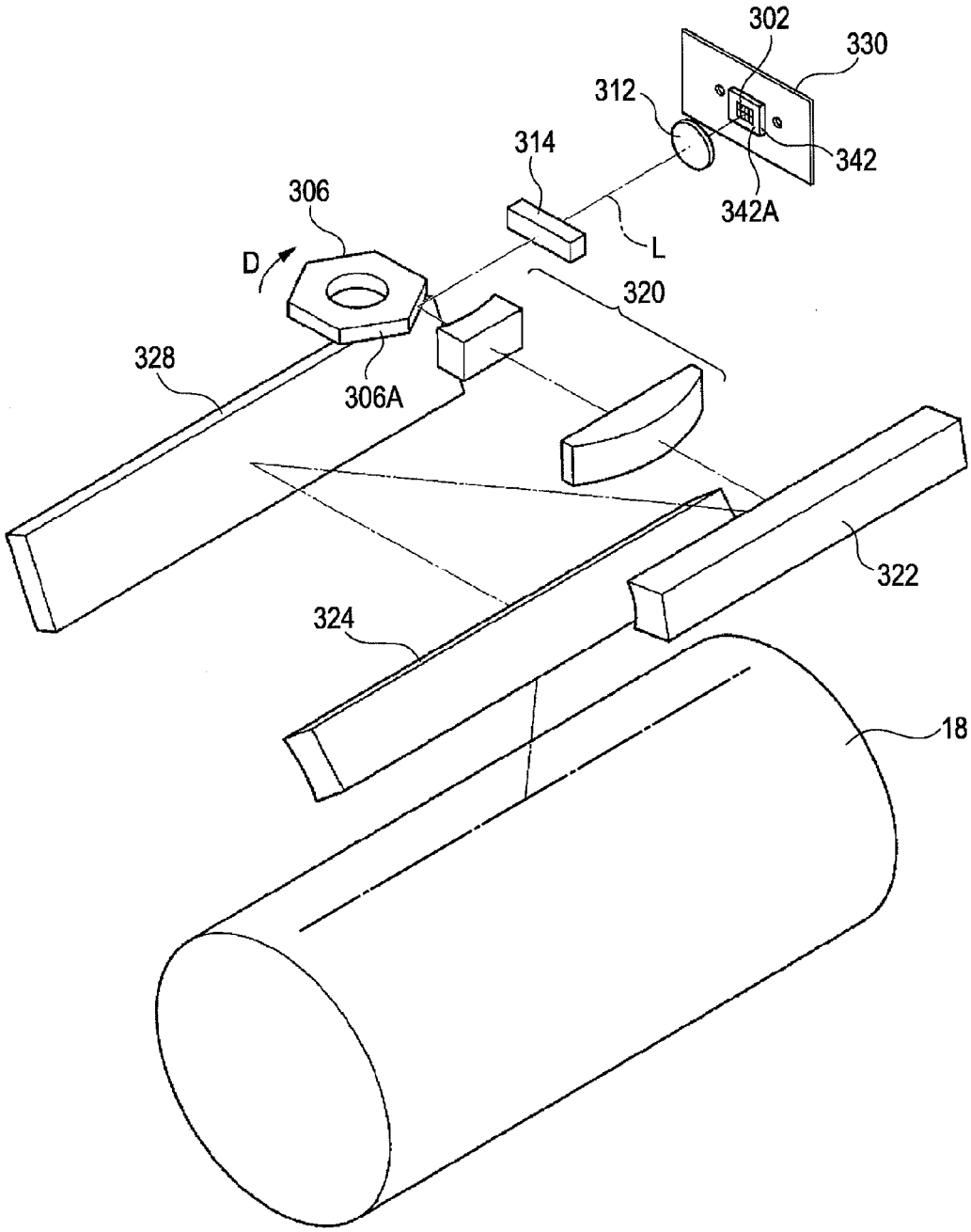
FIG. 10 is a perspective view illustrating the optical structure of the exposure apparatus according to the exemplary embodiment of the present invention.

As illustrated in FIG. 10, each exposure apparatus 40 includes a printed wiring board 330 attached to a housing 40A (see FIG. 11) of the exposure apparatus 40. A light source 302 that emits the light beams L is mounted on the printed wiring board 330. A polygon mirror 306 is provided between the light source 302 mounted on the printed wiring board 330 and the image bearing member 18 irradiated with the light beams L. The polygon mirror 306 is a rotating polygonal mirror that reflects the light beams L emitted from the light source 302 so as to change the direction of the light beams L and that is included in an optical system for guiding the light beams L. The light source 302 and an attachment structure for attaching the light source 302 to the housing 40A will be described below.

Figure 8:
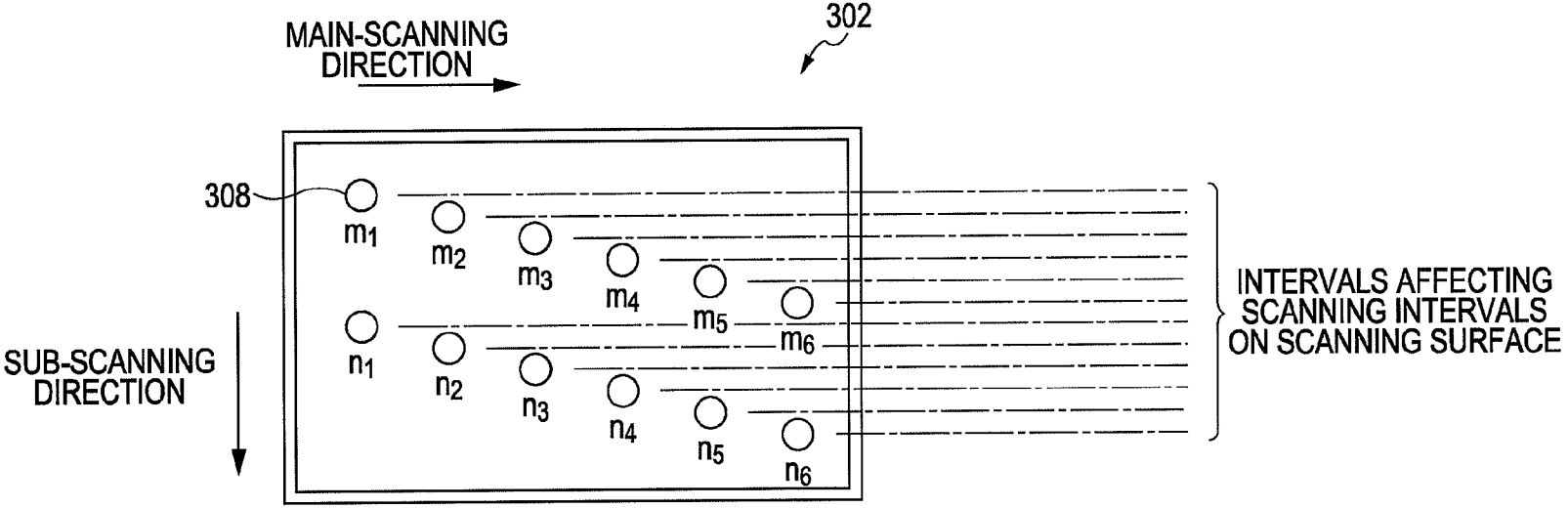
FIG. 8 is a front view illustrating a light source attached by the attachment structure of the light source of the exposure apparatus according to the exemplary embodiment of the present invention.

As illustrated in FIG. 8, the light source 302 is a surface emitting laser in which light-emitting points 308 from which the light beams L are emitted are two-dimensionally arranged. Thus, the light beams L are emitted from the light source 302. More specifically, the light-emitting points 308 are two-dimensionally arranged in the light source 302 along two straight lines that are at predetermined angles with respect to a main-scanning direction and a sub-scanning direction of the emitted light beams L. Six light-emitting points 308 are arranged along each of the two lines at predetermined intervals. The light beams L are modulated and emitted from the respective light-emitting points 308, and the thus-emitted light beams L scan a scanning surface along different scan lines that are spaced from each other in the sub-scanning direction.

Figure 11:
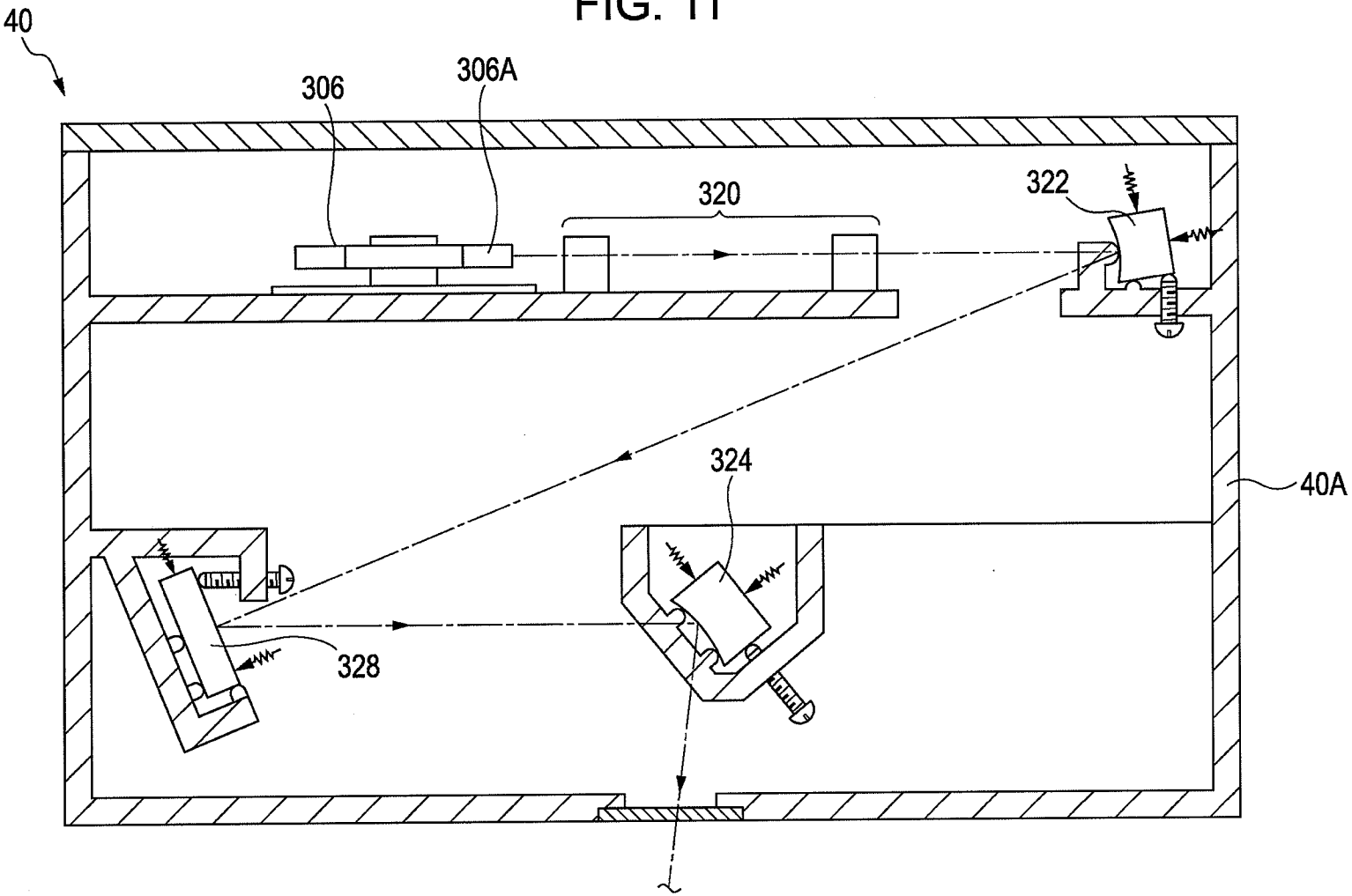
FIG. 11 is a schematic diagram illustrating the exposure apparatus according to the exemplary embodiment of the present invention.

As illustrated in FIGS. 10 and 11, the polygon mirror 306 is a rotating body having the shape of a regular polygonal column (regular hexagonal column in the present exemplary embodiment). The polygon mirror 306 includes six reflecting surfaces 306A at the sides thereof, and rotates about the central axis of the regular hexagonal column in the direction shown by arrow D by a driving force of a motor (not shown).

The light beams L emitted from the light source 302 are simultaneously incident on the same reflecting surface 306A. As the polygon mirror 306 rotates, the incident angle of the light beams L on the reflecting surface 306A continuously varies and the direction in which the light beams L are reflected by the reflecting surface 306A varies accordingly. As a result, the light beams L simultaneously scan the scanning surface (outer peripheral surface) of the image bearing member 18 in the main-scanning direction.

A collimating lens 312 and a cylindrical lens 314, which are also included in the above-described optical system, are arranged in that order on an optical path between the light source 302 and the polygon mirror 306 at positions downstream of the light source 302 along the optical path of the light beams L (hereinafter simply described as "downstream along the optical path"). The collimating lens 312 changes the light beams L emitted from the light-emitting points 308 from divergent light to collimated light. The cylindrical lens 314 causes the light beams L to converge in the sub-scanning direction and guides the light beams L toward the polygon mirror 306.

Figure 9:
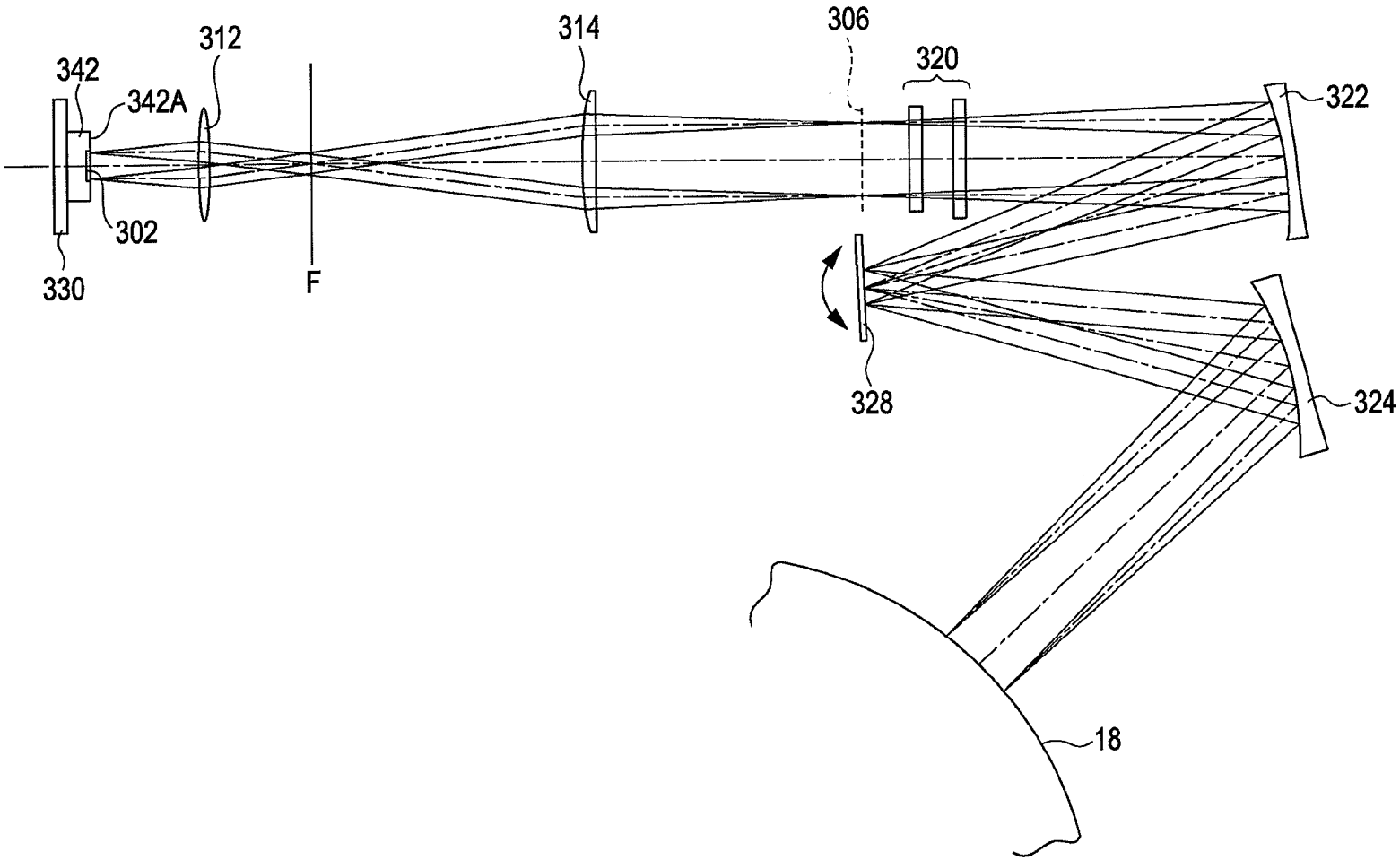
FIG. 9 is a schematic diagram illustrating the optical structure of the exposure apparatus according to the exemplary embodiment of the present invention.

The light beams L emitted from the light source 302 are collimated when the light beams L pass through the collimating lens 312 and converge such that light beams L intersect at a focus position F that is downstream of the collimating lens 312 along the optical path (see FIG. 9).

In addition, as illustrated in FIG. 10, an fθ lens 320, a first cylindrical mirror 322, and a second cylindrical mirror 324 are provided on the optical path between the reflecting surface 306A of the polygon mirror 306 and the scanning surface of the image bearing member 18 at positions downstream of the polygon mirror 306 along the optical path. The fθ lens 320 has power for collecting light only in the main-scanning direction, and makes the scanning speed of the light beams L in the main-scanning direction constant. The first and second cylindrical mirrors 322 and 324 have power for collecting light in the sub-scanning direction.

A reflective mirror 328 that adjusts the angles of the light beams L incident on the second cylindrical mirror 324 in the sub-scanning direction is provided on the optical path between the first cylindrical mirror 322 and the second cylindrical mirror 324.

More specifically, the fθ lens 320 adjusts the light beams L such that the scanning velocity is maintained constant when the light beams L reflected by the polygon mirror 306 scan the scanning surface of the image bearing member 18.

The first and second cylindrical mirrors 322 and 324 have power for collecting light mainly in the sub-scanning direction. The first and second cylindrical mirrors 322 and 324 guide the light beams L to the image bearing member 18 and focus each light beam L on the scanning surface of the image bearing member 18.

The first and second cylindrical mirrors 322 and 324 are disposed such that the image-side focus position of the first cylindrical mirror 322 and the object-side focus position of the second cylindrical mirror 324 coincide with each other, that is, such that the length of the optical path between the first and second cylindrical mirrors 322 and 324 is equal to the sum of the focal lengths of the first and second cylindrical mirrors 322 and 324. Thus, the reflecting surface 306A of the polygon mirror 306 and the scanning position on the peripheral surface of the image bearing member 18 are in afocal relation in the sub-scanning direction and are conjugate with respect to each other.

Next, the light source 302 and the attachment structure for attaching the light source 302 to the housing 40A will be described.

As illustrated in FIG. 10, the light source 302 that emits the light beams L is held by a holding member 342 having a rectangular parallelepiped shape. The light source 302 is mounted on the printed wiring board 330 together with the holding member 342. A surface of the holding member 342 that surrounds the light source 302 and that faces the direction in which the light beams L are emitted serves as a flat positioning surface 342A.

Figure 6:
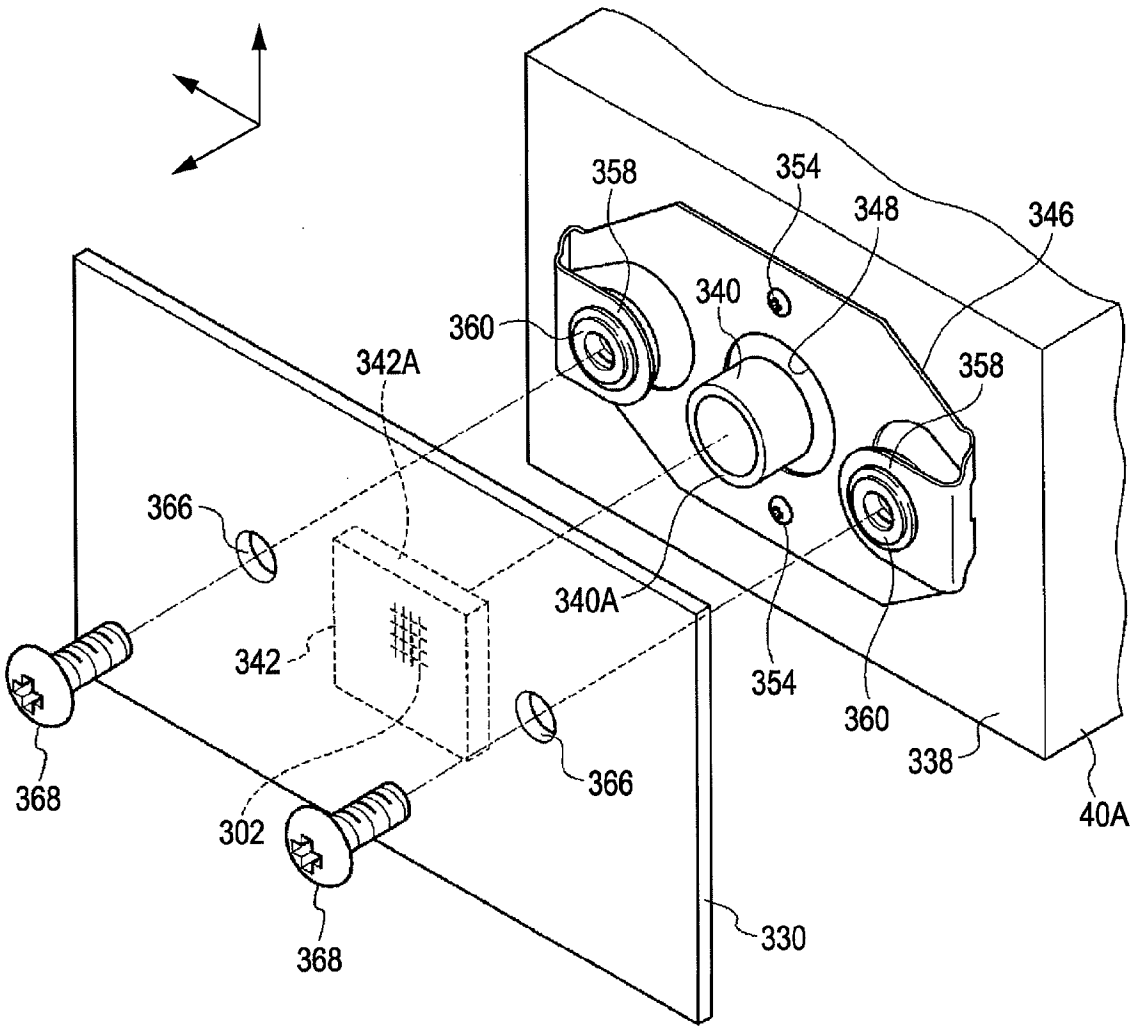
FIG. 6 is a perspective view illustrating the attachment structure of the light source of the exposure apparatus according to the exemplary embodiment of the present invention.

As illustrated in FIG. 6, the housing 40A is provided with a positioning member 340 that projects outward from a flat portion 338 of the housing 40A. The positioning member 340 comes into contact with the positioning surface 342A provided around the light source 302 to position the light source 302 in an optical axis direction.

More specifically, the positioning member 340 has a cylindrical shape that extends in the optical axis direction of the light beams emitted from the light source 302. An end surface 340A of the positioning member 340 that faces the light source 302 comes into contact with the positioning surface 342A around the light source 302 to position the light source 302 with respect to the housing 40A in the optical axis direction.

In addition, an attachment member 346 is provided to urge the positioning surface 342A provided around the light source 302 against the end surface 340A of the positioning member 340 and to attach the light source 302 mounted on the printed wiring board 330 to the housing 40A.

Figure 7:
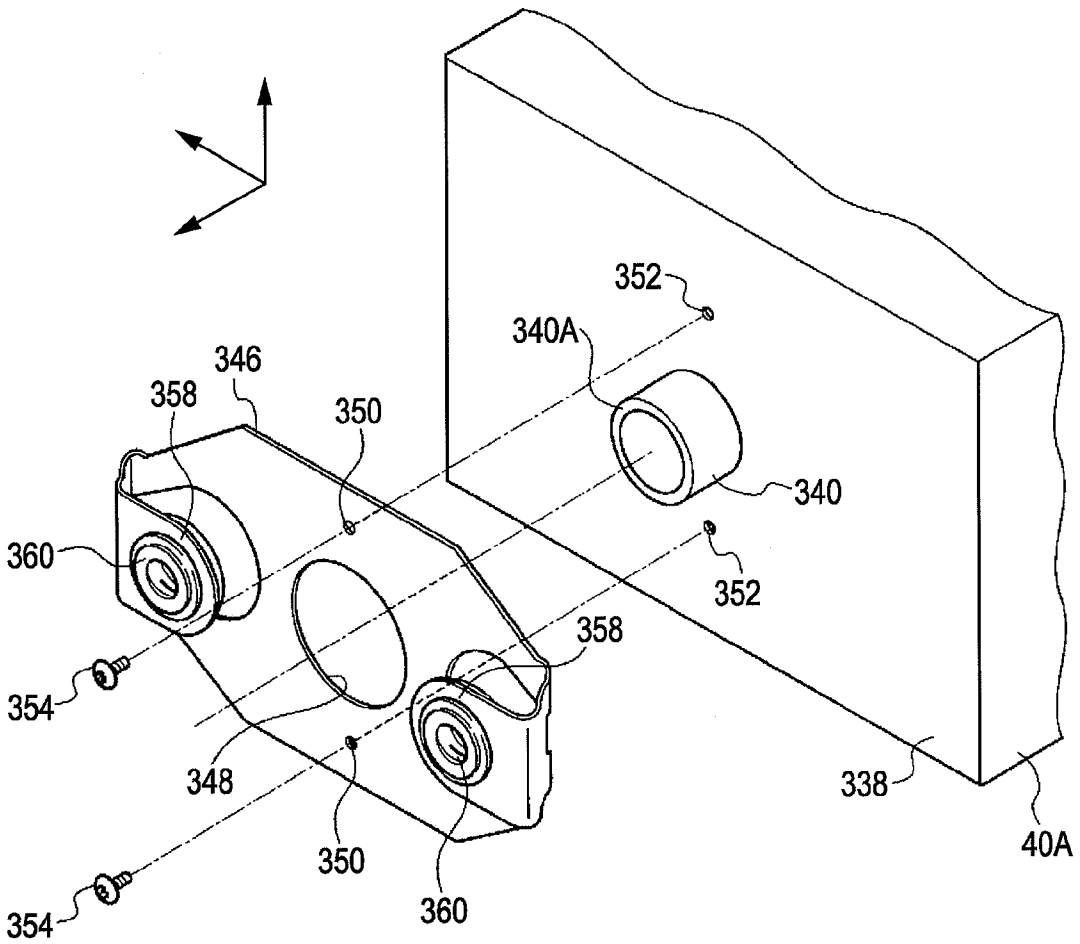
FIG. 7 is a perspective view illustrating the attachment structure of the light source of the exposure apparatus according to the exemplary embodiment of the present invention.

As illustrated in FIG. 7, the attachment member 346 is formed of a spring steel plate and is attached to the flat portion 338 of the housing 40A. A circular hole 348 for receiving the positioning member 340 is formed in the attachment member 346 at a central position thereof. Two small circular holes 350 having a diameter smaller than that of the circular hole 348 are formed one at each side of the circular hole 348 in the vertical direction.

In addition, two screw holes 352 having internal threads are formed in the flat portion 338 of the housing 40A at positions corresponding to the small circular holes 350. Screws 354 are inserted through the small circular holes 350 and screwed into the screw holes 352, so that the attachment member 346 is attached to the flat portion 338 of the housing 40A.

As illustrated in FIG. 6, portions of the attachment member 346 at either side of the circular hole 348 in the horizontal direction extend in directions perpendicular to or substantially perpendicular to the optical axis direction of the light beams and are bent over. The bent portions have attachment surfaces 358 at the ends thereof. When the printed wiring board 330 is attached to the attachment surfaces 358, the attachment member 346 elastically deforms such that the positioning surface 342A provided around the light source 302 is urged against the end surface 340A of the positioning member 340 by the resilience of the attachment member 346.

More specifically, the two attachment surfaces 358 on the attachment member 346 are provided with respective self-locking nuts 360, and circular holes 366 are formed in the printed wiring board 330 at positions corresponding to the self-locking nuts 360.

Figure 3:
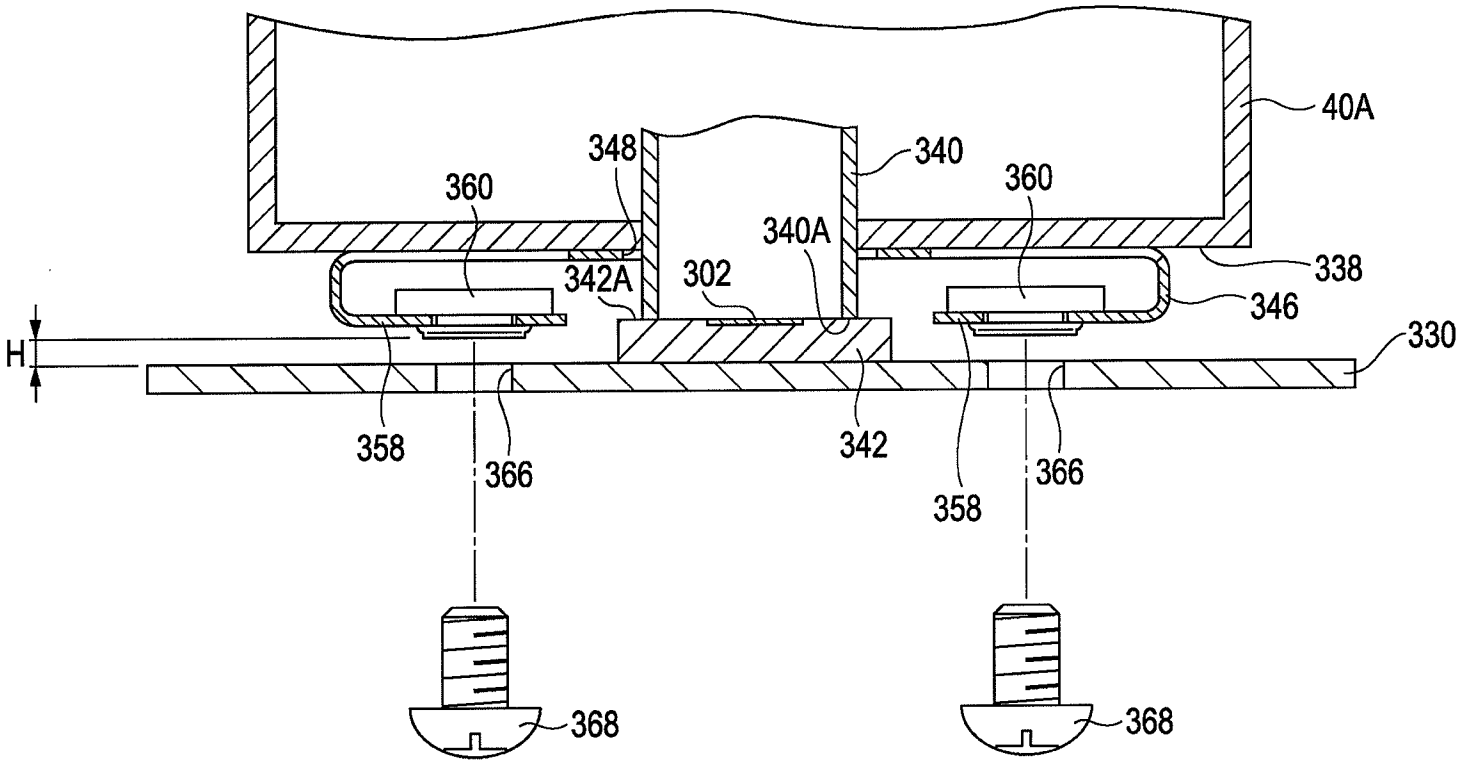
FIG. 3 is a plan view illustrating the attachment structure of the light source of the exposure apparatus according to the exemplary embodiment of the present invention.
Figure 5:
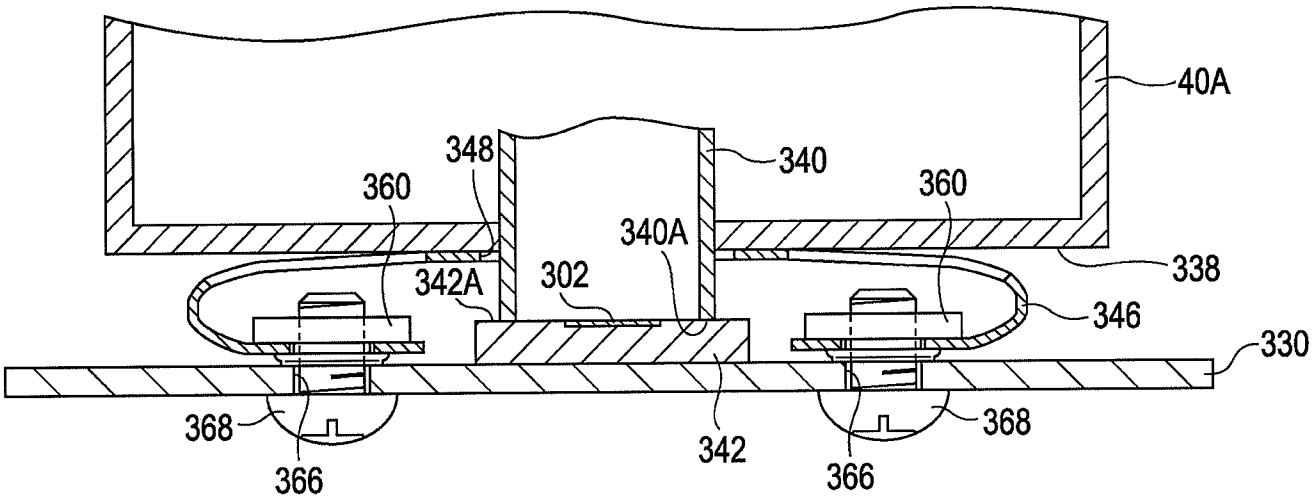
FIG. 5 is a plan view illustrating the attachment structure of the light source of the exposure apparatus according to the exemplary embodiment of the present invention.

As illustrated in FIG. 3, in the state in which the positioning surface 342A around the light source 302 is in contact with the end surface 340A of the positioning member 340, a gap H is provided between the printed wiring board 330 and each of the self-locking nuts 360 fixed to the attachment member 346. As illustrated in FIG. 5, when screws 368 are inserted through the circular holes 366 in the printed wiring board 330 and screwed into the self-locking nuts 360, the attachment member 346 elastically deforms such that the positioning surface 342A around the light source 302 is urged against the end surface 340A of the positioning member 340 by the force (resilience) with which the attachment member 346 tries to return to the original shape.

Figure 1:
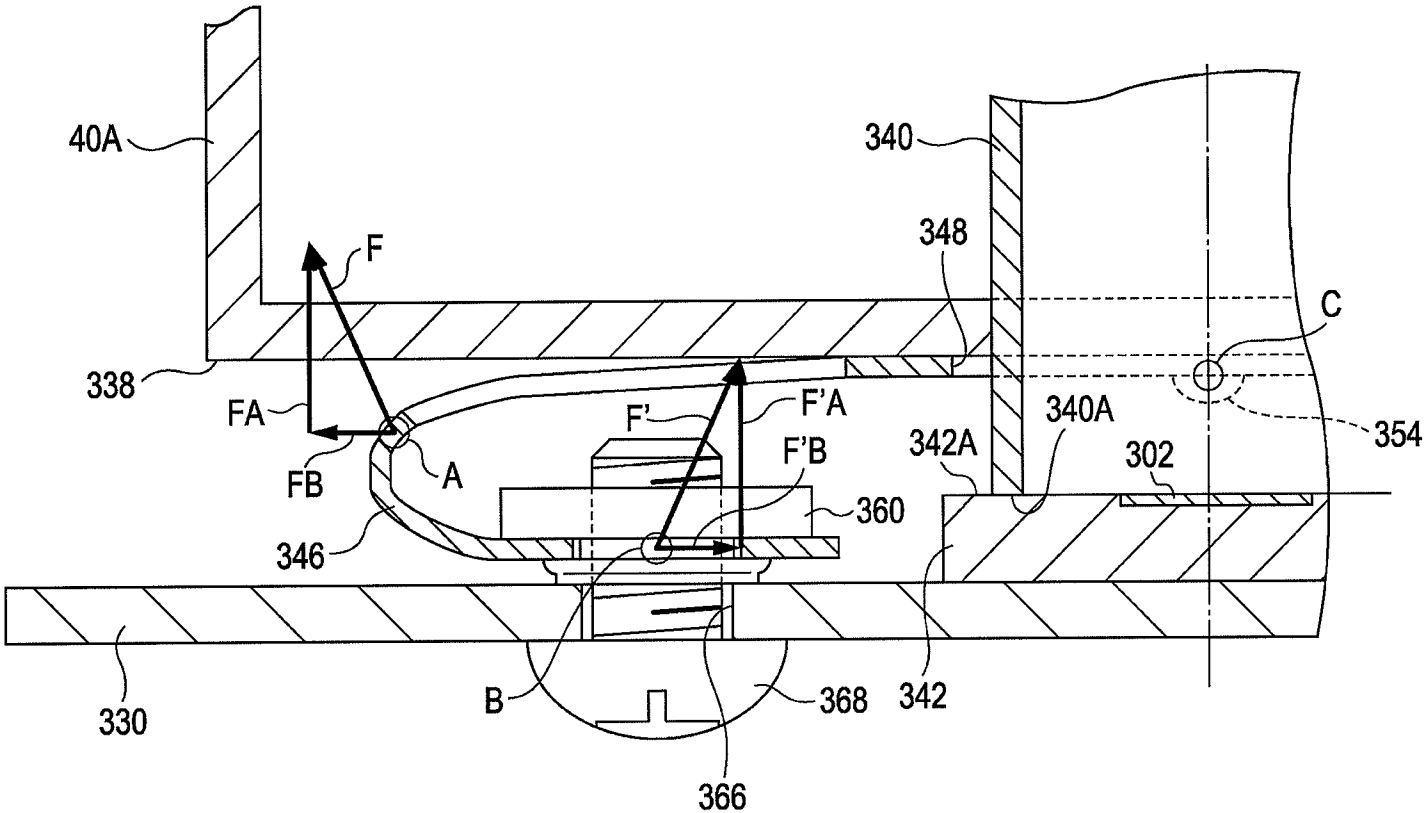
FIG. 1 is an enlarged plan view illustrating an attachment structure of a light source of an exposure apparatus according to an exemplary embodiment of the present invention.

As illustrated in FIG. 1, in the state in which each screw 368 is screwed into the corresponding self-locking nut 360 and the attachment member 346 is deformed, the following urging forces F and F' are applied at each side of the attachment member 346 in the horizontal direction. That is, at a portion A that protrudes outward, the urging force F is applied in a direction inclined obliquely outward with the attachment position C of the attachment member 346 (position at which the screws 354 are fixed) at the center. In addition, at a portion B at which the self-locking nut 360 is fixed, the urging force F' is applied in a direction inclined obliquely inward with the portion A at the center.

The urging force F applied at the portion A is divided into a component FA in the optical axis direction and a component FB in a direction perpendicular to the optical axis direction. The urging force F' applied at the portion B is divided into a component F'A in the optical axis direction and a component F'B in a direction perpendicular to the optical axis direction. Since the component FB and the component F'B are in opposite directions, the components FB and F'B substantially cancel each other. Therefore, the movement of the printed wiring board 330 in the direction perpendicular to the optical-axis direction is suppressed.

Operation

Figure 2:
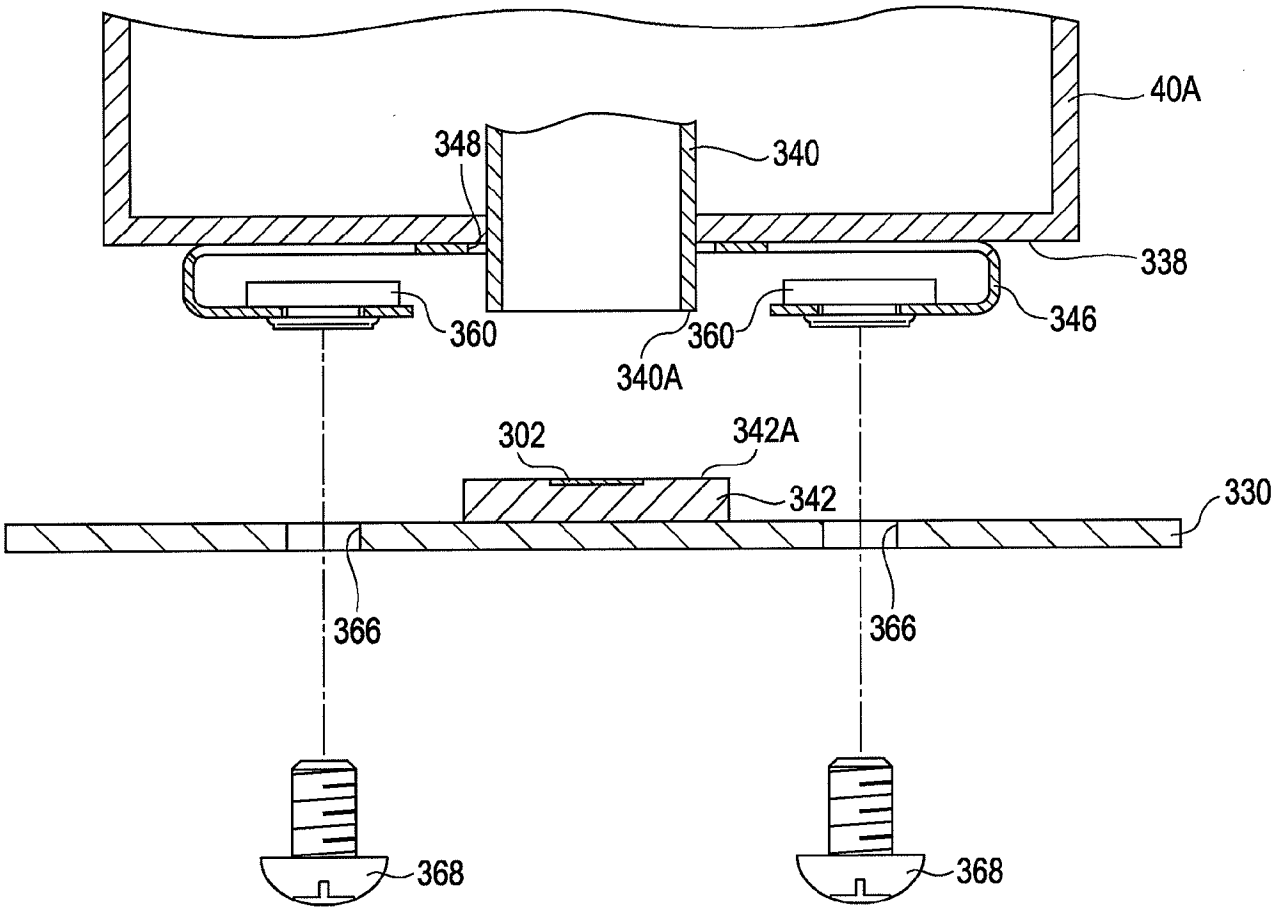
FIG. 2 is a plan view illustrating the attachment structure of the light source of the exposure apparatus according to the exemplary embodiment of the present invention.

As illustrated in FIGS. 2 and 6, to attach the printed wiring board 330 on which the light source 302 is mounted to the housing 40A, the two screws 368 are inserted through the circular holes 366 in the printed wiring board 330 and are screwed into the respective self-locking nuts 360. Thus, the printed wiring board 330 on which the light source 302 is mounted is attached to the housing 40A.

More specifically, as illustrated in FIG. 3, first, a worker brings the positioning surface 342A around the light source 302 into contact with the end surface 340A of the positioning member 340. In this state, the gap H is provided between the printed wiring board 330 on which the light source 302 is mounted and each of the self-locking nuts 360 attached to the attachment member 346.

Figure 4:
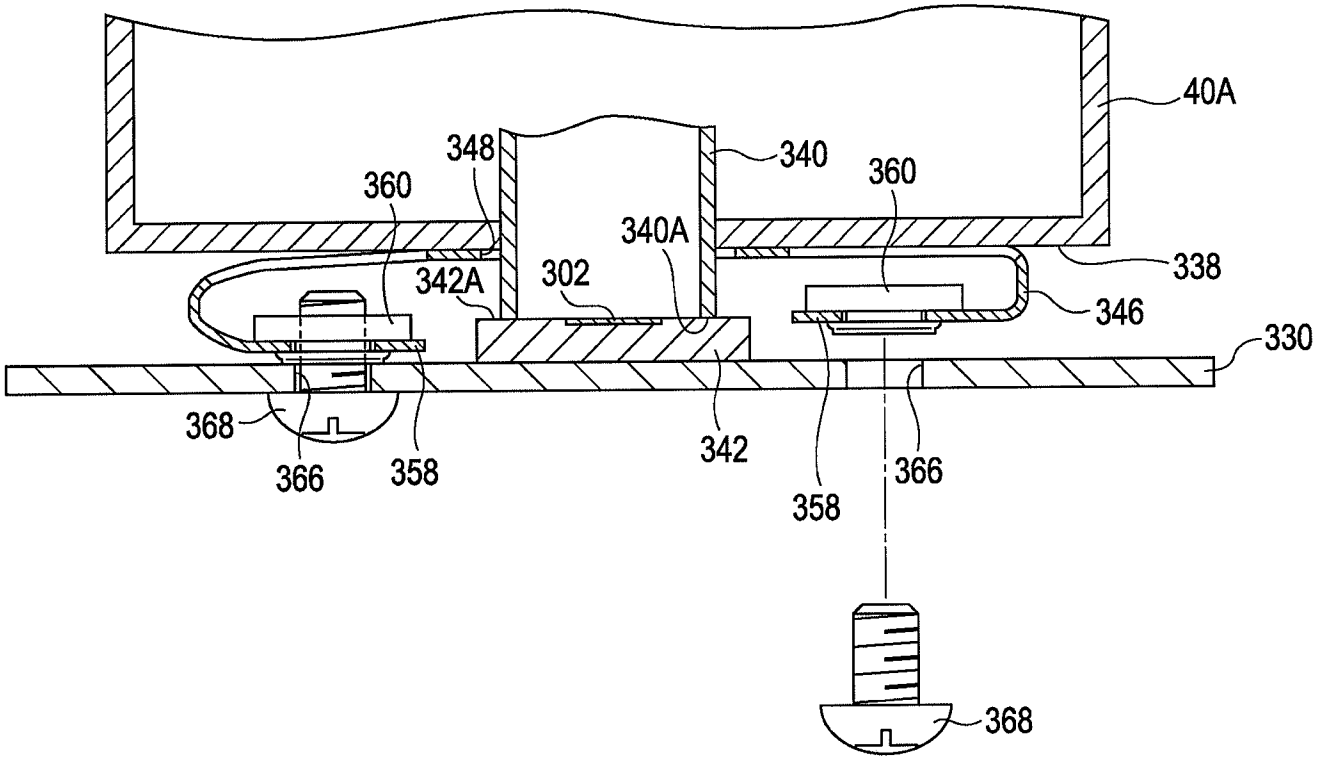
FIG. 4 is a plan view illustrating the attachment structure of the light source of the exposure apparatus according to the exemplary embodiment of the present invention.

Then, as illustrated in FIG. 4, the worker holds the printed wiring board 330 in one hand and one of the screws 368 in the other hand, inserts the screw 368 through one of the circular holes 366 formed in the printed wiring board 330, and fixes the screw 368 to the corresponding self-locking nut 360. When the screw 368 is screwed into the self-locking nut 360, a portion of the attachment member 346 on one side of the positioning member 340 deforms so as to eliminate the gap H. Thus, the attachment surface 358 of the attachment member 346 at one side thereof is attached to the printed wiring board 330.

Then, as illustrated in FIG. 5, in the state in which one of the screws 368 extends through one of the circular holes 366 and is screwed into the corresponding self-locking nut 360, the worker holds the printed wiring board 330 in one hand and the other screw 368 in the other hand. The worker inserts the screw 368 through the other one of the circular holes 366 formed in the printed wiring board 330, and fixes the screw 368 to the corresponding self-locking nut 360. When the screw 368 is screwed into the self-locking nut 360, a portion of the attachment member 346 on the other side of the positioning member 340 deforms so as to eliminate the gap H. Thus, the attachment surface 358 of the attachment member 346 at the other side thereof is attached to the printed wiring board 330.

Thus, the attachment member 346 deforms and the positioning surface 342A around the light source 302 is urged against the end surface 340A of the positioning member 340 by the force with which the attachment member 346 tries to return to the original shape. As a result, the light source 302 is positioned in the optical axis direction.

In addition, as illustrated in FIG. 1, the component FB of the urging force F applied at the portion A in the direction perpendicular to the optical axis direction and the component F'B of the urging force F' applied at the portion B in the direction perpendicular to the optical axis direction substantially cancel each other. Therefore, the movement of the printed wiring board 330 in the direction perpendicular to the optical-axis direction is suppressed. As a result, the attachment position accuracy of the light source 302 in the direction perpendicular to the optical axis direction can be increased.

Since the movement of the printed wiring board 330 in the direction perpendicular to the optical axis direction is suppressed, the screws 368 can be screwed into the self-locking nuts 360 one at a time while suppressing the movement of the printed wiring board 330 in the direction perpendicular to the optical axis direction.

In addition, since the movement of the printed wiring board 330 in the direction perpendicular to the optical axis direction is suppressed, the position of the light source 302 in the direction perpendicular to the optical axis direction can be easily adjusted.

In addition, since the movement of the printed wiring board 330 in the direction perpendicular to the optical axis direction is suppressed, the position of the light source 302 can be maintained after the position adjustment thereof. In other words, the light source 302 does not move in the direction perpendicular to the optical axis direction.

Although the exemplary embodiment of the present invention is described in detail above, the present invention is not limited to the above-described exemplary embodiment. For example, although two attachment surfaces 358 are provided on the attachment member 346 in the above-described exemplary embodiment, the number of attachment surfaces 358 is not limited to two, and may instead be one or three or more.

In addition, although two attachment surfaces 358 are formed on a single attachment member 346 in the above-described exemplary embodiment, attachment members that are provided with respective attachment surfaces may be provided instead.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An exposure apparatus, comprising:

a light source that emits a plurality of light beams;

a substrate on which the light source is mounted;

a positioning member provided on a housing and being in contact with a positioning surface provided around the light source to position the light source with respect to the housing in an optical axis direction, the housing accommodating an optical system that guides the light beams; and a u-shaped attachment member that has a plurality of portions, a first portion of the portions is attached to the substrate with a first fixing member, a second portion of the portions is attached to the housing with a second fixing member, and a third portion is a bent u-shaped portion that connects the first portion and the second portion together, wherein the substrate is drawn closer to the housing by the u-shaped attachment member.

2. An image forming apparatus, comprising:

the exposure apparatus according to claim 1;

an image bearing member irradiated with the light beams emitted from the exposure apparatus so that an electrostatic latent image is formed on an outer peripheral surface of the image bearing member; and a developing device configured to develop the electrostatic latent image on the outer peripheral surface of the image bearing member to visualize the electrostatic latent image as a toner image.

3. The image forming apparatus according to claim 1, wherein the positioning surface around the light source is urged against the positioning member by a resilience against elastic deformation of the attachment member.

4. The image forming apparatus according to claim 1, wherein the first portion overlaps the second portion in a direction perpendicular to the substrate.

5. The image forming apparatus according to claim 1, wherein the first fixing member and the second fixing member are screws.

6. An exposure apparatus, comprising:

a light source that emits a plurality of light beams;

a substrate on which the light source is mounted;

a positioning member provided on a housing and being in contact with a positioning surface provided around the light source to position the light source with respect to the housing in an optical axis direction, the housing accommodating an optical system that guides the light beams; and an attachment member that has a plurality of portions, a first portion of the portions is attached to the substrate with a first fixing member, a second portion of the portions is attached to the housing with a second fixing member, and a third portion is a bent portion that connects the first portion and the second portion together, wherein a fix part of the first portion is a part where the first portion is attached to the substrate by the first fixing member, and the fix part overlaps the second portion, and wherein the substrate is drawn closer to the housing by the attachment member.

7. An image forming apparatus, comprising:

the exposure apparatus according to claim 6;

an image bearing member irradiated with the light beams emitted from the exposure apparatus so that an electrostatic latent image is formed on an outer peripheral surface of the image bearing member; and a developing device configured to develop the electrostatic latent image on the outer peripheral surface of the image bearing member to visualize the electrostatic latent image as a toner image.

8. The image forming apparatus according to claim 6, wherein the positioning surface around the light source is urged against the positioning member by a resilience against elastic deformation of the attachment member.

9. The image forming apparatus according to claim 6, wherein the fix part overlaps the second portion in a direction perpendicular to the substrate.

10. The image forming apparatus according to claim 6, wherein the first fixing member and the second fixing member are screws.

* * * * *